US009678468B2

(12) United States Patent
Isobe et al.

(10) Patent No.: US 9,678,468 B2
(45) Date of Patent: Jun. 13, 2017

(54) CLEANING APPARATUS, PROCESS CARTRIDGE, IMAGE FORMING APPARATUS

(71) Applicant: CANON KABUSHIKI KAISHA, Tokyo (JP)

(72) Inventors: Yuta Isobe, Kawasaki (JP); Takayuki Namiki, Yokohama (JP); Nobuo Oshima, Inagi (JP); Masanori Tanaka, Yokohama (JP); Naoki Hayashi, Kawasaki (JP); Shigemi Kamoshida, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/857,644

(22) Filed: Sep. 17, 2015

(65) Prior Publication Data

US 2016/0085201 A1 Mar. 24, 2016

(30) Foreign Application Priority Data

Sep. 22, 2014 (JP) ..... 2014-192223
Jan. 15, 2015 (JP) ..... 2015-006005

(51) Int. Cl.
*G03G 21/00* (2006.01)
*G03G 21/12* (2006.01)

(52) U.S. Cl.
CPC ..... *G03G 21/0011* (2013.01); *G03G 21/12* (2013.01)

(58) Field of Classification Search
CPC combination set(s) only.
See application file for complete search history.

(56) References Cited

U.S. PATENT DOCUMENTS

| | | | | |
|---|---|---|---|---|
| 7,499,670 | B2 * | 3/2009 | Kim | G03G 21/12 399/351 |
| 2007/0196149 | A1 * | 8/2007 | Sato | G03G 21/12 399/360 |
| 2011/0176817 | A1 * | 7/2011 | Kim | G03G 21/12 399/12 |
| 2013/0051882 | A1 * | 2/2013 | Yang | G03G 21/1814 399/360 |

FOREIGN PATENT DOCUMENTS

| | | | | |
|---|---|---|---|---|
| JP | 58-203479 | A | 11/1983 | |
| JP | S58203479 | A * | 11/1983 | G03G 21/007 |
| JP | 05-232846 | A | 9/1993 | |
| JP | 2004-133263 | A | 4/2004 | |

* cited by examiner

*Primary Examiner* — Clayton E Laballe
*Assistant Examiner* — Jas Sanghera
(74) *Attorney, Agent, or Firm* — Canon U.S.A. Inc., IP Division

(57) ABSTRACT

There is provided a cleaning apparatus including a cleaning member configured to collect developer on an image bearing member, and a storage chamber configured to store the developer, wherein cross-sectional areas of a lengthwise center and an end portion of the storage chamber in a lengthwise direction of the storage chamber are different, the cross sections being orthogonal to the lengthwise direction.

25 Claims, 16 Drawing Sheets

CLEANING APPARATUS, PROCESS CARTRIDGE, IMAGE FORMING APPARATUS

BACKGROUND OF THE INVENTION

Field of the Invention

The present invention relates to arrangements for storage of developer. In particular, the present invention relates to cleaning apparatuses, process cartridges, and image forming apparatuses.

Description of the Related Art

An electrostatic recording method, an electrophotographic recording method, and the like are widely used in conventional image forming apparatuses such as copying machines and printers. A commonly-known method is a method in which a toner image formed on an image bearing member is transferred onto a recording material to form the toner image on the recording material. In this method, however, there may be a case where the toner image on the image bearing member is incompletely transferred onto the recording material to leave a small amount of toner on the image bearing member. Further, there may be a case where a small amount of toner called fog toner may be developed in a non-image forming portion on the image bearing member.

In a case of using a method in which a charging device is brought into contact with an image bearing member to charge the image bearing member, residual toner on the image bearing member may adhere to the charging device to cause charging failure that may lead to vertical streaks and uneven image density. To address this problem, a cleaning method is commonly used in which an elastic member is brought into contact with the image bearing member to scrape and collect the toner on the image bearing member.

In the foregoing apparatus, the collected toner on the image bearing member is stored in a collected toner storage chamber. Some collected toner storage chambers include a partition plate to secure stiffness to enable appropriate contact of a cleaning blade with an image bearing member and to prevent collected toner from becoming uneven when it is removed from the image forming apparatus and slanted (Japanese Patent Application Laid-Open No. 58-203479).

Further, there is a method of conveying collected toner by rotating a screw or a stirrer member (Japanese Patent Application Laid-Open No. 2004-133263).

Depending on an image pattern used by a user and the size of a recording medium, however, the amount of toner collected from the image bearing member may become uneven in an axial direction of the image bearing member.

SUMMARY OF THE INVENTION

According to an aspect of the present invention, a cleaning apparatus includes a cleaning member configured to collect developer on an image bearing member, and a storage chamber configured to store the developer, wherein cross-sectional areas of a lengthwise center and an end portion of the storage chamber in a lengthwise direction of the storage chamber are different, the cross sections being orthogonal to the lengthwise direction.

According to another aspect of the present invention, a cleaning apparatus includes a storage chamber configured to store developer, a cleaning member configured to collect developer on an image bearing member, and a guide unit provided in the storage chamber and configured to guide movement of the developer collected by the cleaning member, wherein the guide unit includes a guide surface configured to guide the developer in a direction that recedes from the cleaning member and is toward a lengthwise center of the cleaning member from a lengthwise end portion of the cleaning member.

According to yet another aspect of the present invention, a cleaning apparatus includes a storage chamber configured to store developer, a cleaning member configured to collect developer on an image bearing member, and a guide unit provided in the storage chamber and configured to guide movement of the developer collected by the cleaning member, wherein the guide unit includes a guide surface configured to guide the developer in a direction that recedes from the cleaning member and is toward a lengthwise end portion of the cleaning member from a lengthwise center of the cleaning member.

Further, according to the present invention, there is provided a process cartridge and an image forming apparatus.

Further features of the present invention will become apparent from the following description of exemplary embodiments with reference to the attached drawings.

DESCRIPTION OF THE EMBODIMENTS

Various exemplary embodiments of the invention will be described below with reference to the drawings. It is apparent that the dimensions, materials, shapes, relative positions, etc. of components described in the exemplary embodiments can be changed as appropriate according to a structure of an apparatus to which the invention is applied and various types of conditions, and the exemplary embodiments described below are not intended to limit the scope of the invention.

The following describes an exemplary embodiment of the present invention in detail with reference to the drawings. A first exemplary embodiment will be described.

The direction of a rotation axis line of an electrophotographic photosensitive member (hereinafter "photosensitive drum 1"), which is an image bearing member, will be referred to as a lengthwise direction K (direction of an arrow K in FIG. 5).

Further, in the lengthwise direction K, the side of the photosensitive drum 1 that receives driving force from a body of an image forming apparatus will be referred to as a driving side (driving force reception unit 63*a* side in FIG. 5), and the opposite side will be referred to as a non-driving side.

An entire structure and an image formation process will be described below with reference to FIGS. 2 and 3.

Figure 2:
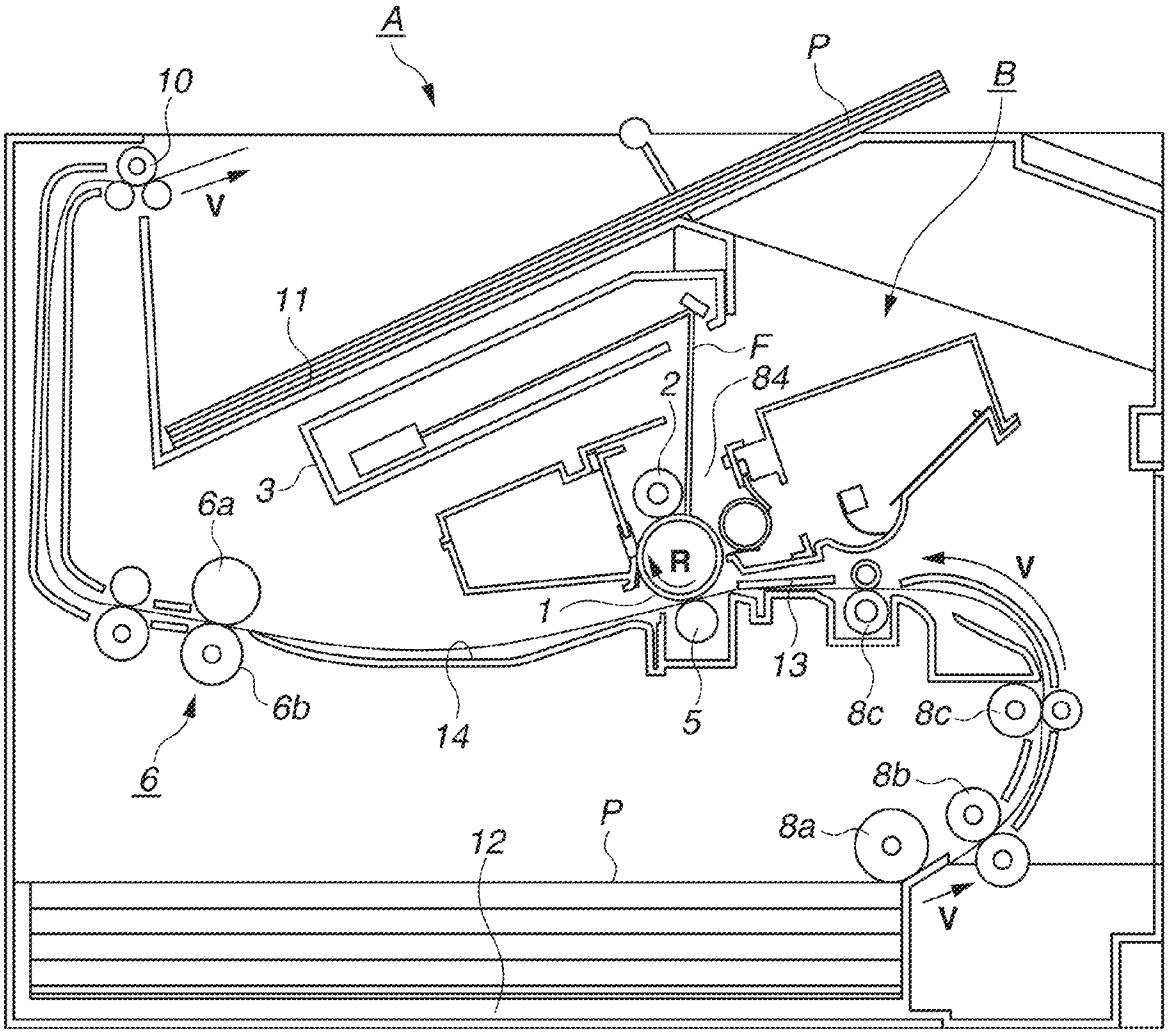
FIG. 2 is a schematic cross sectional view illustrating an image forming apparatus according to the first exemplary embodiment of the present invention.

FIG. 2 is a cross sectional view illustrating a body of an electrophotographic image forming apparatus (hereinafter, the body will be referred to as "apparatus body A") and a cartridge B, according to an exemplary embodiment of the present invention. FIG. 3 is a cross sectional view illustrating the cartridge B according to the first exemplary embodiment of the present invention.

As used herein, the apparatus body A refers to a part of the structure of the image forming apparatus excluding at least the cartridge B. Further, a cleaning apparatus may be arranged to be independently attachable to and detachable from the apparatus body. In this case, the apparatus body refers to a part of the structure of the image forming apparatus excluding a development device. (Entire structure of apparatus body)

In FIG. 2, the apparatus body A is a laser beam printer using electrophotographic technology, and the cartridge B is attachable to and detachable from the apparatus body A. When the cartridge B is attached to the apparatus body A, an exposure device 3 (laser scanner unit) is located above the cartridge B.

Further, a sheet tray 12 storing a recording material (hereinafter "sheet material P") on which an image is to be formed is disposed below the cartridge B.

Further, the apparatus body A includes a pickup roller 8*a*, a pair of sheet feeding rollers 8*b*, a pair of conveying rollers 8*c*, a transfer guide 13, a transfer roller 5, a conveyance guide 14, a fixing device 6, a pair of discharge rollers 10, a sheet discharge tray 11, etc., which are disposed in this order along a conveying direction V in which a sheet material P is to be conveyed. The fixing device 6 includes a heating roller 6*a* and a pressing roller 6*b*.

(Image Formation Process)

The following schematically describes an image formation process. Based on a print start signal, the photosensitive drum 1 is rotated and driven in the direction of an arrow R at a predetermined circumferential velocity (process speed).

A charging roller 2, which is a charging unit to which bias voltage is applied, is brought into contact with an outer surface of the photosensitive drum 1 to uniformly and evenly charge the outer surface of the photosensitive drum 1.

The exposure device 3 outputs a laser beam F corresponding to image information. The laser beam F passes through an exposure window section 84 of an upper surface of the cartridge B to scan and expose the outer surface of the photosensitive drum 1.

Thereby, an electrostatic latent image (or electrostatic image) corresponding to the image information is formed on the outer surface of the photosensitive drum 1.

Figure 3:
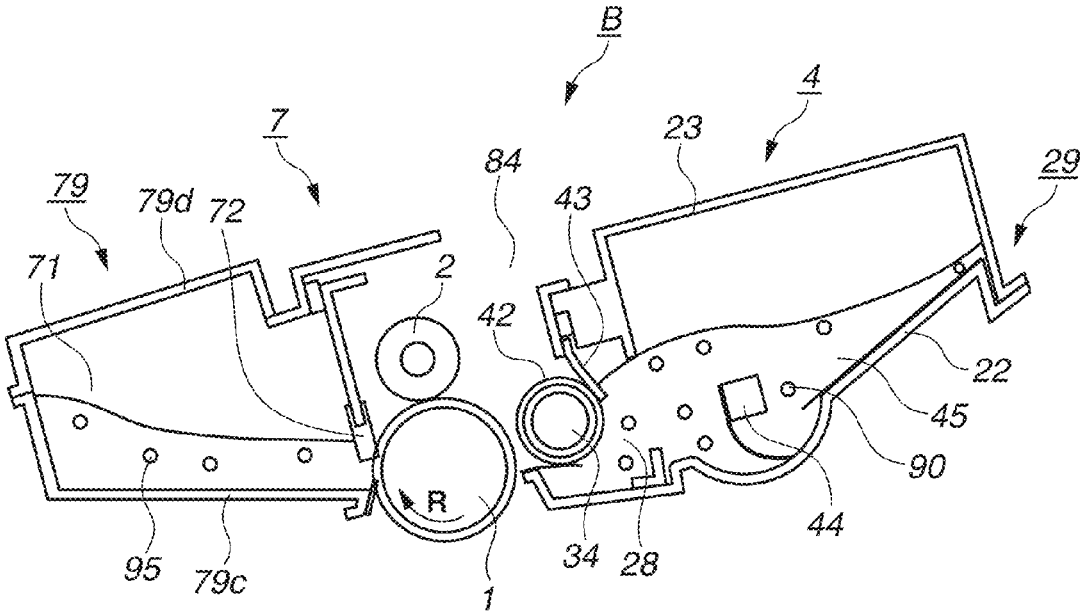
FIG. 3 is a schematic cross sectional view illustrating a cartridge according to the first exemplary embodiment of the present invention.

Meanwhile, as illustrated in FIG. 3, in a development device 4, toner 90 in a developer (hereinafter "toner") chamber 45 is stirred and conveyed by the rotation of a conveying member 44 and sent to a toner supply chamber 28. The toner 90 is borne on a surface of a development sleeve 42, which is a developer bearing member, by the magnetic force of a magnet roller 34 (fixed magnet). A development blade 43 triboelectrically charges the toner 90 while regulating the thickness of a layer on an outer surface of the development sleeve 42. The toner 90 is transferred onto the photosensitive drum 1, which is an image bearing member, according to the electrostatic latent image (or electrostatic image) and visualized as a toner image.

Further, as illustrated in FIG. 2, a sheet material P stored in a lower part of the apparatus body A is fed from the sheet tray 12 in the direction of an arrow V by the pickup roller 8*a*, the pair of sheet feeding rollers 8*b*, and the pair of conveying rollers 8*c* in synchronization with the output timing of the laser beam F. Then, the sheet material P is supplied via the transfer guide 13 to a transfer position between the photosensitive drum 1 and the transfer roller 5. At the transfer position, the toner image is sequentially transferred from the photosensitive drum 1 to the sheet material P.

The sheet material P to which the toner image has been transferred is separated from the photosensitive drum 1 and conveyed to the fixing device 6 along the conveyance guide 14. Then, the sheet material P is passed through a nip portion between the heating roller 6*a* and the pressing roller 6*b* included in the fixing device 6. At the nip portion, a pressing/heat fixing process is performed to fix the toner image to the sheet material P. The sheet material P having undergone the process of fixing the toner image is conveyed to the pair of discharge rollers 10 and then discharged to the sheet discharge tray 11.

Meanwhile, as illustrated in FIG. 3, residual toner on the outer surface of the photosensitive drum 1 after the transfer is removed by a cleaning blade 72. The toner removed from the photosensitive drum 1 is stored in a collected toner storage chamber 71 of a cleaning apparatus 7.

The charging roller 2, the development sleeve 42, and the cleaning blade 72 are a process unit that operates on the photosensitive drum 1 according to the present exemplary embodiment. The process unit needs to operate at least on the photosensitive drum that is an image bearing member. Thus, the process unit is not limited to the foregoing arrangement and only needs to include at least one of a charging unit, a development unit, and a cleaning unit.

(Attachment/Detachment of Cartridge)

Figure 4:
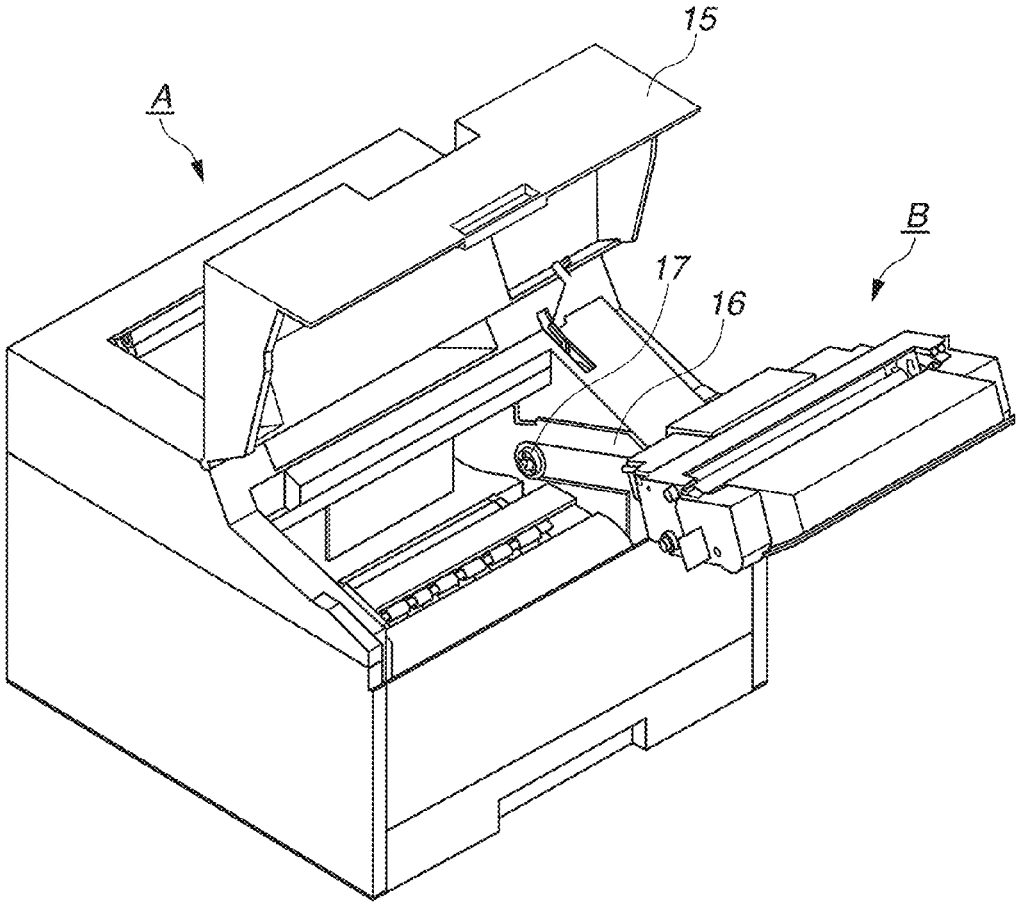
FIG. 4 is a schematic perspective view illustrating a body of an image forming apparatus with a door opened and a cartridge, according to the first exemplary embodiment of the present invention.

The following describes the attachment/detachment of the cartridge B to/from the apparatus body A, with reference to FIGS. 3 and 4.

FIG. 4 is a perspective view illustrating the apparatus body A and the cartridge B. A door 15 of the apparatus body A is opened to attach/detach the cartridge B.

The door 15 is rotatably attached to the apparatus body A. When the door 15 is opened, there is a guide rail 16 provided, and the cartridge B is attached into the apparatus body A along the guide rail 16. Then, a driving shaft 17, which is driven by a motor (not illustrated) of the apparatus body A, is engaged with the driving force reception unit 63*a* (FIG. 5) provided to the cartridge B. Thereby, the photosensitive drum 1 connected to the driving force reception unit 63*a* receives the driving force from the apparatus body A and rotates. Further, power is supplied to the charging roller 2 and the development sleeve 42 from a power supply unit (not illustrated) of the apparatus body A.

(Entire Structure of Cartridge)

Figure 5:
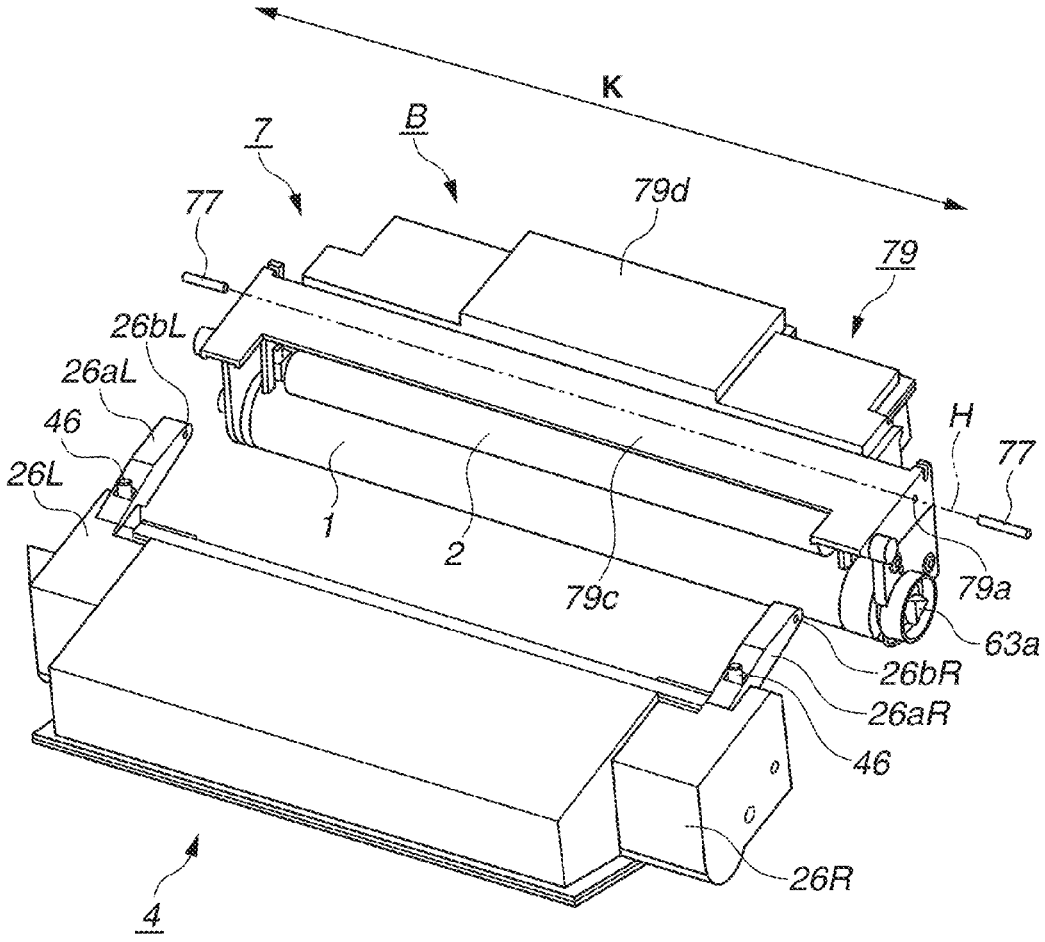
FIG. 5 is a schematic perspective view illustrating a structure of a cartridge according to the first exemplary embodiment of the present invention.

The following describes the entire structure of the cartridge B with reference to FIGS. 3 and 5. FIG. 5 is a perspective view illustrating the structure of the cartridge B.

In the cartridge B, the cleaning apparatus 7 and the development device 4 are combined together to form a process cartridge. This, however, is not a limiting example, and the cleaning apparatus or the development device may singly be attachable to and detachable from the apparatus body.

The cleaning apparatus 7 refers to an apparatus that at least includes the cleaning blade 72, which is a cleaning member, and a storage chamber for storing developer. The storage chamber includes a cleaning frame 79. The cleaning apparatus according to the present exemplary embodiment further includes the photosensitive drum 1, the charging roller 2, etc., which are rotating members.

Meanwhile, the development device 4 includes a bottom member 22, a developer container 23, a first side member 26L, a second side member 26R, the development blade 43, the development sleeve 42, a magnet roller 34, the conveying member 44, the toner 90, a biasing member 46, etc.

The cleaning apparatus 7 and the development device 4 are rotatably connected together by connecting members 77 to form the cartridge B.

Specifically, the development device 4 includes arm units 26*a*L and 26*a*R, and the arm units 26*a*L and 26*a*R respectively are formed at the first side member 26L and the second side member 26R located at respective end portions of the development device 4 in a lengthwise direction (axial line direction of a development sleeve 42). Rotation holes 26*b*L and 26*b*R are formed in respective front end portions of the arm units 26*a*L and 26*a*R. The rotation holes 26*b*L and 26*b*R are parallel to the axial line direction of the development sleeve 42.

Then, the development device 4 is aligned with a predetermined position in the cleaning frame 79 to align the rotation holes 26*b*L and 26*b*R with an insertion hole 79*a* on the same axis. Then, the connecting members 77 are inserted into the rotation holes 26*b*L and 26*b*R and the insertion hole 79*a*. In this way, the cleaning apparatus 7 and the development device 4 are engaged to be rotatable about an axial line H connecting the connecting members 77.

At this time, the biasing members 46 attached to bases of the arm units 26*a*L and 26*a*R come into contact with the cleaning frame 79 to bias the development device 4 to the cleaning apparatus 7 with the connecting members 77 being a rotation center. In this way, the development sleeve 42 is reliably pressed in the direction of the photosensitive drum 1. Then, the development sleeve 42 is held at a predetermined interval from the photosensitive drum 1 by interval maintaining members 38 (FIG. 6) attached to respective end portions of the development sleeve 42.

(Development Device)

Figure 6:
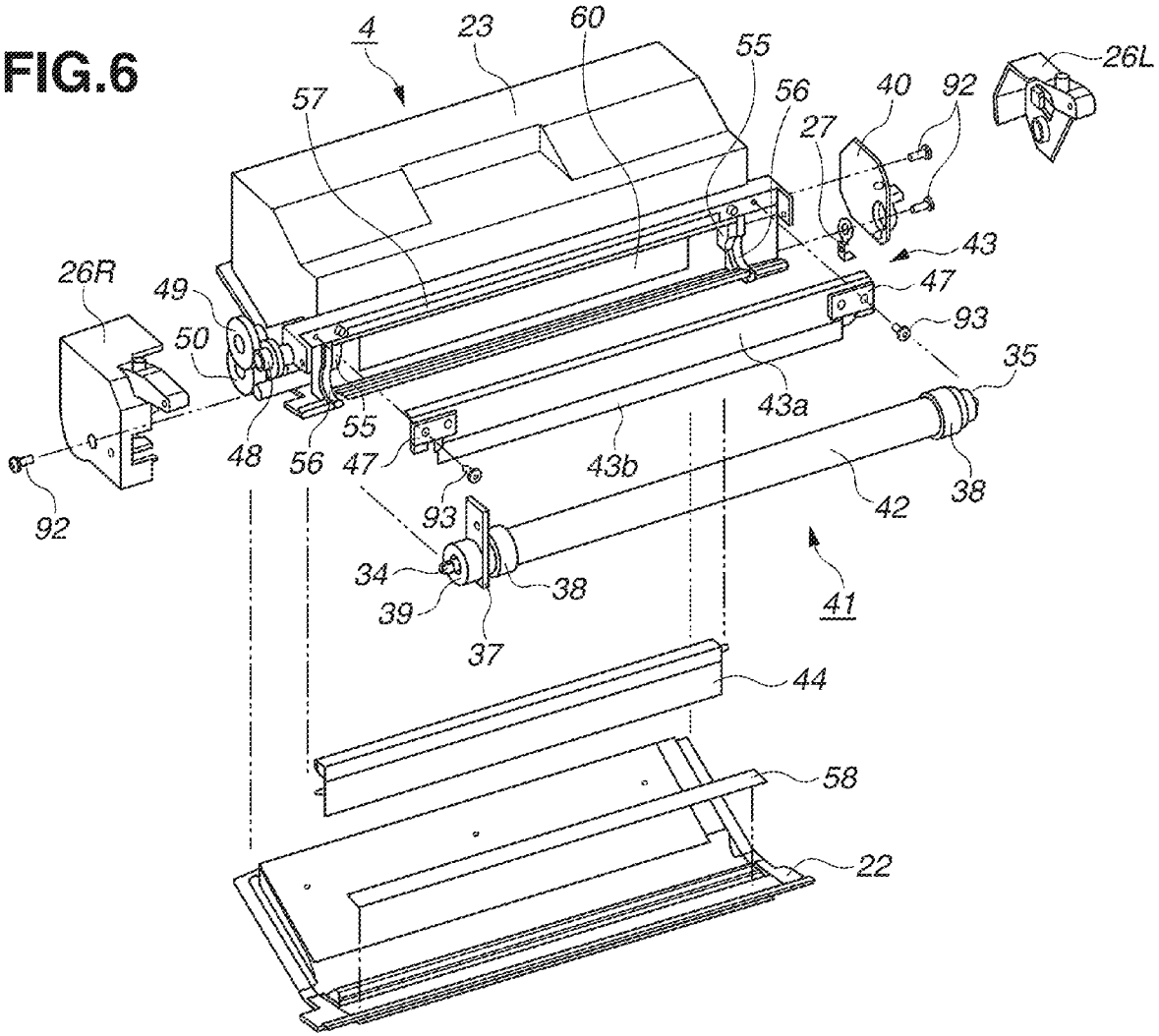
FIG. 6 is a schematic perspective view illustrating a structure of a development device according to the first exemplary embodiment of the present invention.

The following describes the structure of the development device 4 with reference to FIG. 6. FIG. 6 is an exploded perspective view illustrating the structure of the development device 4.

A development frame member 29 (FIG. 3) including the developer container 23 and the bottom member 22 forms the toner chamber 45, which stores the toner 90, and the toner supply chamber 28 (FIG. 3). The bottom member 22 and the developer container 23 are integrated by a process such as ultrasonic fusion.

The non-driving side of the conveying member 44 is supported by the developer container 23, and the driving side of the conveying member 44 is supported by a conveying gear 50 attached to the developer container 23. Thereby, the conveying member 44 is rotated according to the conveying gear 50 in the toner chamber 45.

A toner seal member 60 is thermally welded to the developer container 23 and separates the toner chamber 45 and the toner supply chamber 28. This prevents leakage of the toner 90 from the toner chamber 45 while the cartridge B is transported. The toner seal member 60 is opened before the use so that the toner 90 is supplied to the toner supply chamber 28.

A first seal member 55, a second seal member 56, and a third seal member 57 are provided at predetermined positions in the developer container 23. A fourth seal member 58 is provided at a predetermined position in the bottom member 22 after the bottom member 22 is connected to the developer container 23.

The first seal member 55 prevents leakage of the toner 90 from lengthwise end portions of an elastic member 43*b* of the development blade 43. The second seal member 56 prevents leakage of the toner 90 from lengthwise end portions of the development sleeve 42. The third seal member 57 is provided across the lengthwise direction to prevent leakage of the toner 90 from between a support member 43*a* of the development blade 43 and the developer container 23. The fourth seal member 58 is provided across the lengthwise direction and in contact with the development sleeve 42 to prevent leakage of the toner 90 from a lower side of the development sleeve 42.

The development blade 43 includes the support member 43*a* made of a sheet metal and the elastic member 43*b* made of an elastic material such as urethane rubber. Together with cleaner members 47, respective end portions of the support member 43*a* are fixed to predetermined positions in the developer container 23 with screws 93. The elastic member 43*b* contacts the development sleeve 42 to regulate the amount of toner on the outer surface of the development sleeve 42 and apply triboelectric charge.

The cleaner members 47 are in contact with surfaces of end portions of the development sleeve 42 to clean an attached matter such as toner.

A development sleeve unit 41 includes the development sleeve 42, the magnet roller 34, a flange 35, the interval maintaining members 38, bearing members 37 and 40, a development sleeve gear 39, etc.

The magnet roller 34 is inserted from the end portion of the development sleeve 42 on the non-driving side, and the flange 35 is forcibly inserted in the end portion and fixed. A conductive electrode member (not illustrated) is embedded in the flange 35, and the electrode member (not illustrated) is in contact with the development sleeve 42 and an electrode member 27. The conductive electrode member 27 is fixed to the bearing member 40. The electrode member 27 is in contact with the power supply unit (not illustrated) of the apparatus body A, and power is supplied to the development sleeve 42 through the electrode member 27 and the electrode member (not illustrated) of the flange 35.

The interval maintaining members 38 are attached to the lengthwise end portions of the development sleeve 42. On the driving side, the bearing member 37 is disposed outside the interval maintaining member 38, and the development sleeve gear 39 is embedded outside the bearing member 37. The development sleeve 42 is rotatably supported by the bearing members 37 and 40 disposed at the respective ends.

A first gear 48 and a second gear 49, which are drive transmission members, are rotatably attached to the development frame member 29. Thereby, a flange gear unit 63*b* (FIG. 7), the development sleeve gear 39, the first gear 48, the second gear 49, and the conveying gear 50 are sequentially engaged and rotated to transmit the driving force received from the apparatus body A to the development sleeve 42 and the conveying member 44.

The bearing member 40 and the second side member 26R are fixed to the respective end portions of the development frame member 29 in the lengthwise direction with screws 92. At this time, the first side member 26L of the development sleeve unit 41 is attached rotatably by the bearing member 40.

(Structure of Cleaning Apparatus)

Figure 7:
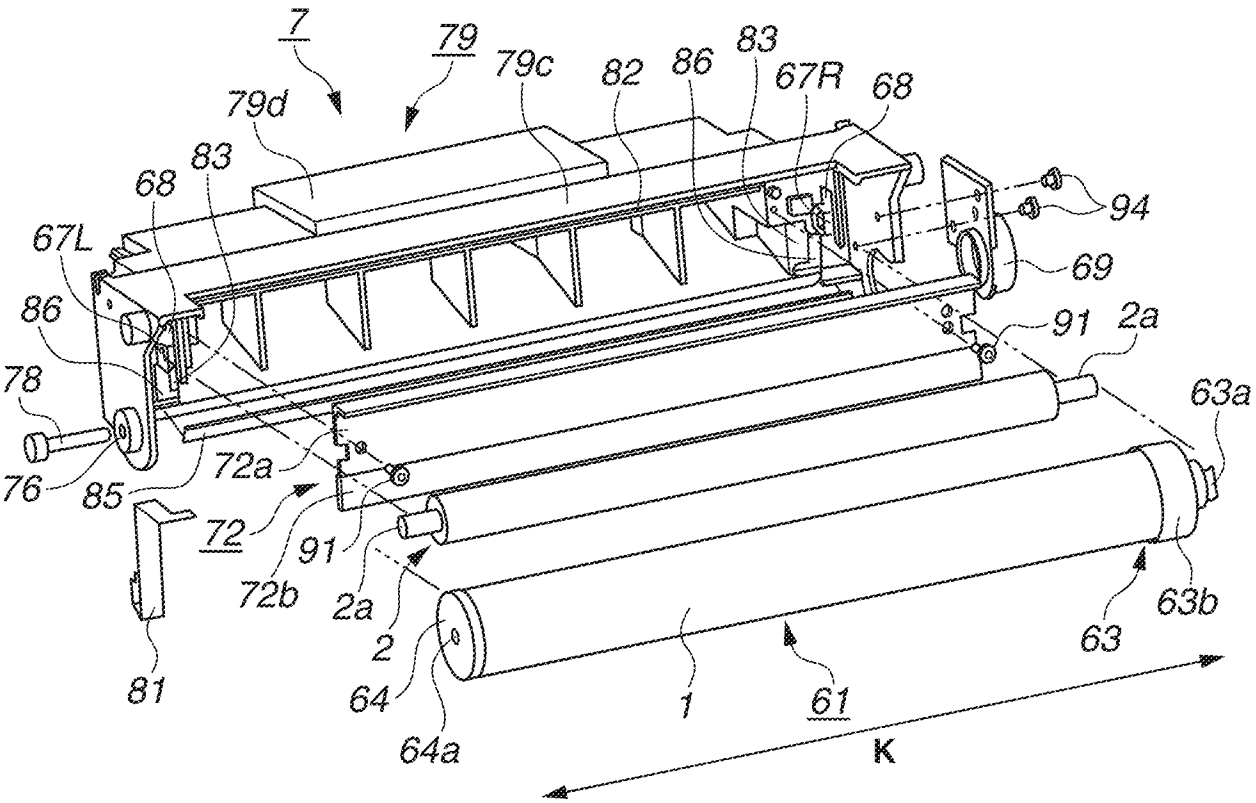
FIG. 7 is a schematic perspective view illustrating a structure of a cleaning apparatus according to the first exemplary embodiment of the present invention.

The following describes the structure of the cleaning apparatus 7 with reference to FIG. 7. FIG. 7 is an exploded perspective view illustrating the structure of the cleaning apparatus 7.

The cleaning blade 72 includes a support member 72*a* made of a plate metal and an elastic member 72*b* made of an elastic material such as urethane rubber. Respective end portions of the support member 72*a* are fixed with screws 91 so that the cleaning blade 72 is located in a predetermined position relative to the cleaning frame 79. The elastic member 72*b* is in contact with the photosensitive drum 1 to remove residual toner on the outer surface of the photosensitive drum 1. The removed toner is stored in the collected toner storage chamber 71 (FIG. 3) of the cleaning apparatus 7.

A first seal member 82, a second seal member 83, an end portion seal member 86, and a flexible sheet member 85 are provided in predetermined positions in the cleaning frame 79.

The first seal member 82 is provided across a lengthwise direction K to prevent leakage of collected developer (toner) 95 from between the support member 72*a* of the cleaning blade 72 and the cleaning frame 79. The second seal member 83 prevents leakage of the collected toner 95 from the lengthwise ends of the elastic member 72*b* of the cleaning blade 72. The end portion seal member 86 prevents leakage of the collected toner 95 from the lengthwise ends of the elastic member 72*b* of the cleaning blade 72 while removing an attached matter such as the toner 90 on the photosensitive drum 1.

The flexible sheet member 85 is made of a plastic film such as polyethylene terephthalate, polyphenylene sulfide, etc. In the present exemplary embodiment, the thickness of the flexible sheet member 85 is about 38 μm. The flexible sheet member 85 is provided to be in contact with the photosensitive drum 1 across the lengthwise direction K to prevent leakage of the collected toner 95 from an upstream side in the rotation direction of the photosensitive drum 1 relative to the cleaning blade 72.

An electrode member 81, a biasing member 68, and charging roller bearings 67L and 67R are attached to the cleaning frame 79. A shaft portion 2*a* of the charging roller 2 is fitted into the charging roller bearings 67L and 67R. The charging roller 2 is biased to the photosensitive drum 1 by the biasing member 68 and is rotatably supported by the charging roller bearings 67L and 67R. The charging roller 2 is rotated according to the rotation of the photosensitive drum 1.

The electrode member 81, the biasing member 68, the charging roller bearing 67L, and the shaft portion 2*a* are conductive. The electrode member 81 is in contact with the power supply unit (not illustrated) of the apparatus body A. Power is supplied to the charging roller 2 through the electrode member 81, the biasing member 68, the charging roller bearing 67L, and the shaft portion 2*a*.

The photosensitive drum 1 is integrally combined with the flanges 64 and 63 to form an electrophotographic photosensitive drum unit 61 (hereinafter "drum unit"). This combining method uses caulking, bonding, welding, etc. The flange 64 is combined with an earth contact point (not illustrated), etc. Further, the flange 63 includes the driving force reception unit 63*a* and the flange gear unit 63*b*. The driving force reception unit 63*a* receives the driving force from the apparatus body A, and the flange gear unit 63*b* transmits the drive to the development sleeve 42. A bearing member 69 is integrally fixed to the driving side of the cleaning frame 79 with screws 94, and a drum shaft 78 is pressed and inserted, and fixed to the non-driving side of the cleaning frame 79. The bearing member 69 is fitted into the flange 63, and the drum shaft 78 is inserted into a press insertion portion 76 provided to the non-driving side and fitted into a hole 64*a* of the flange 64. In this way, the drum unit 61 is rotatably supported by the cleaning frame 79. The fixing of the bearing member 69 to the cleaning frame 79 is not limited to the screws 94.

(Structures of Cleaning Casing and Collected Toner Storage Chamber)

The following describes the structures of the cleaning frame 79 and the collected toner storage chamber 71 with reference to FIGS. 1A to 1C, 8A, 8B, and 9A to 9C. Further, the direction in which the collected toner is conveyed from the photosensitive drum 1 toward the storage chamber 71 will be referred to as a conveying direction D.

Figure 1A:
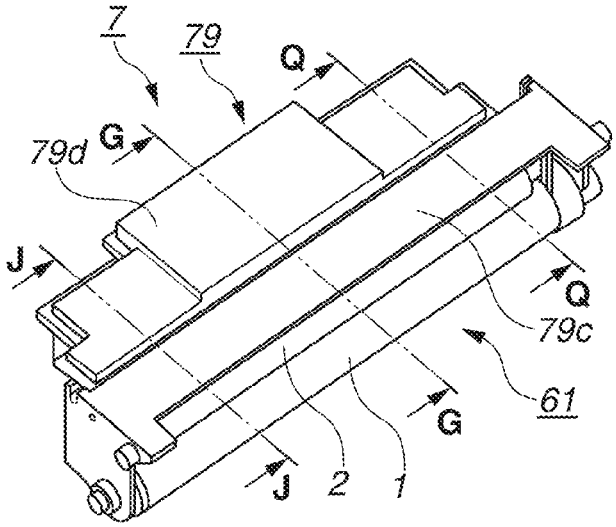
FIGS. 1A, 1B, and 1C are schematic views illustrating a cleaning apparatus according to a first exemplary embodiment of the present invention.
Figure 1B:
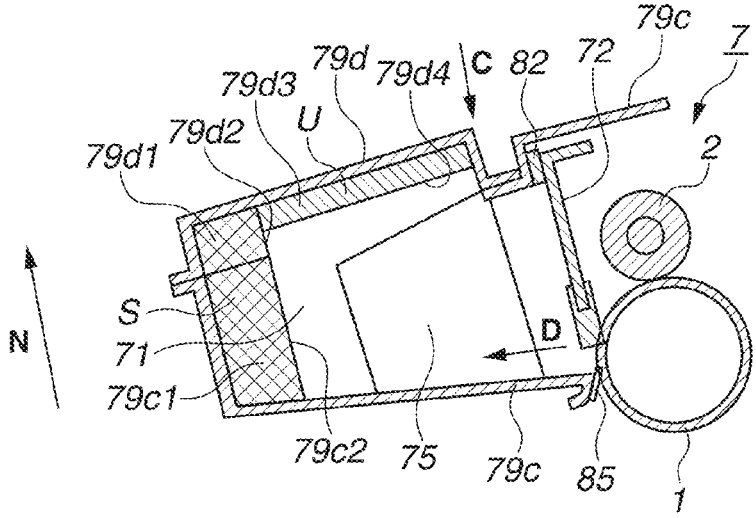
Figure 1C:
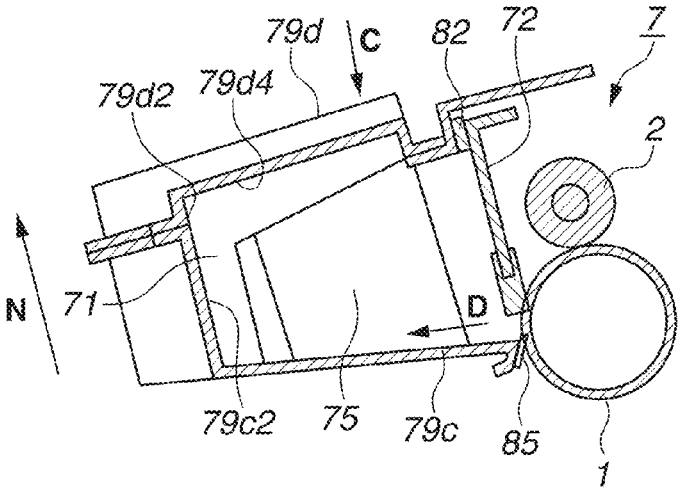
Figure 8A:
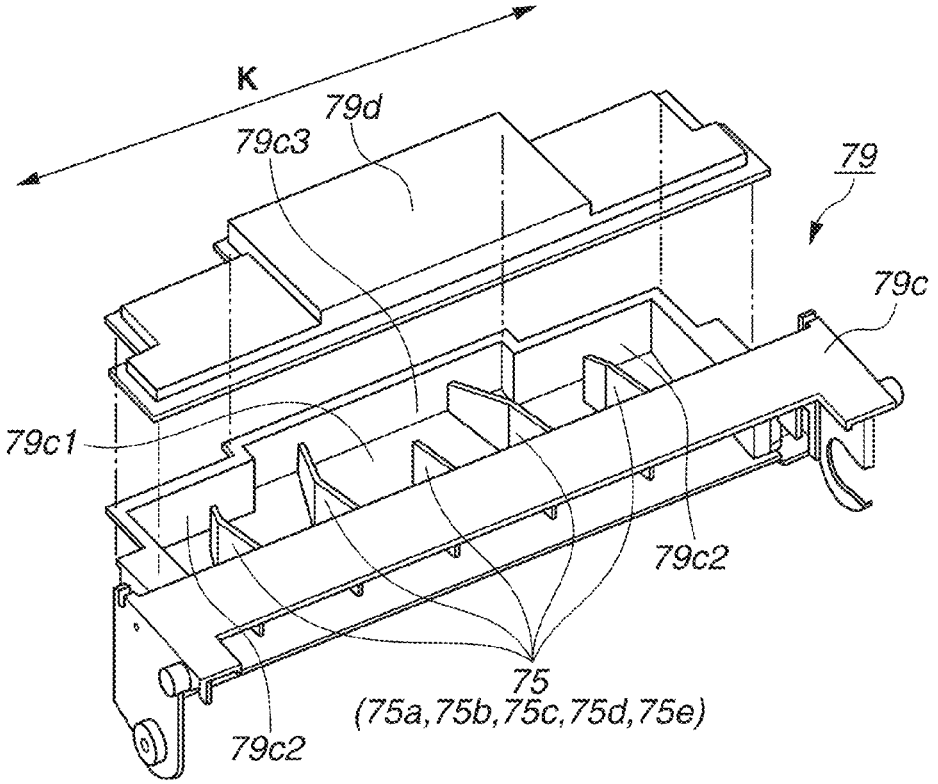
FIGS. 8A and 8B are schematic views illustrating a cleaning frame according to the first exemplary embodiment of the present invention.
Figure 8B:
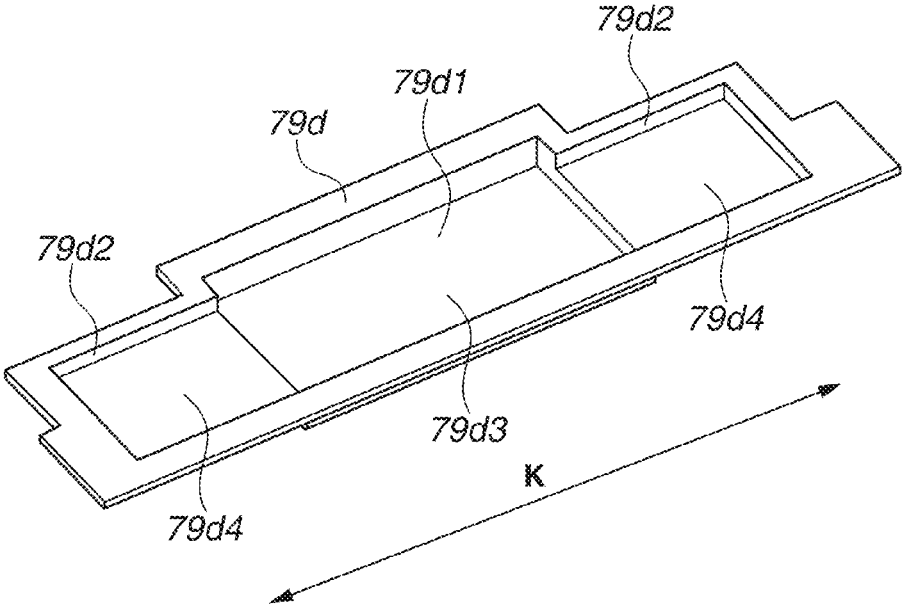
Figure 9A:
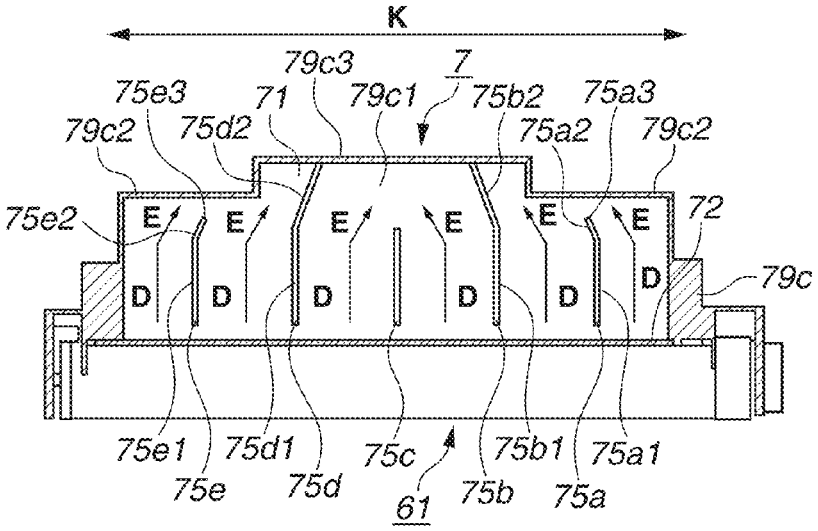
FIGS. 9A, 9B, and 9C are schematic cross sectional views illustrating a state in which collected toner is stored in a collected toner storage chamber according to the first exemplary embodiment of the present invention.
Figure 9B:
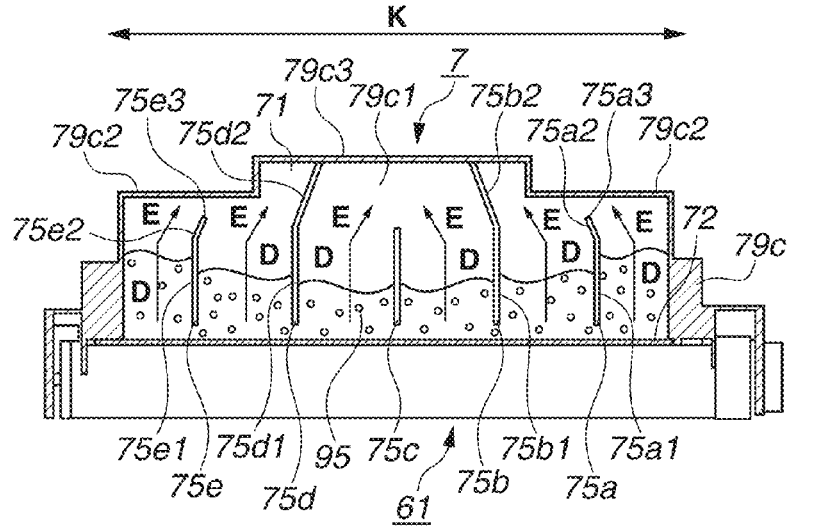
Figure 9C:
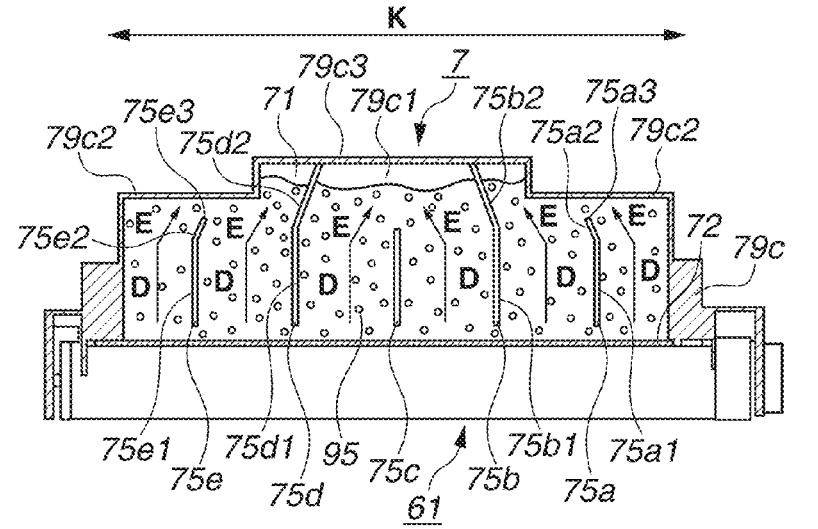

FIG. 1A is a schematic perspective view illustrating the cleaning apparatus 7. FIG. 1B is a schematic cross sectional view (cross section G-G in FIG. 1A) illustrating a lengthwise center of the collected toner storage chamber 71. FIG. 1C is a schematic cross sectional view (cross section J-J in FIG. 1A) illustrating a lengthwise end portion of the collected toner storage chamber 71. The cross sections J-J and Q-Q in FIG. 1A have the same shape. Thus, the cross section J-J (FIG. 1A) will be used in the following description. FIG. 8A is an exploded perspective view illustrating the structure of the cleaning frame 79. FIG. 8B is a schematic perspective view illustrating a cleaning cover 79*d* viewed from the collected toner storage chamber 71 side. FIG. 9A is a schematic cross sectional view illustrating the cleaning frame 79 viewed from a vertical (arrow C in FIG. 1B or 1C) side relative to the conveying direction D. FIG. 9B is a schematic cross sectional view illustrating the state in which the collected toner 95 is stored in the collected toner storage chamber 71. FIG. 9C is a schematic cross sectional view illustrating the state in which the collected toner 95 is accumulated up to a conveyance downstream.

The following describes the structure of the cleaning frame 79 with reference to FIGS. 1A-1C and 8A. The cleaning frame 79 holds the drum unit 61 and the cleaning blade 72 and includes a cleaning casing 79*c* and the cleaning cover 79*d*. The cleaning casing 79*c* includes a rib 75, which is a guide unit. The cleaning cover 79*d* is integrally combined with the cleaning casing 79*c* by a process such as ultrasonic welding, etc. (FIG. 1A).

The storage chamber 71 is a space to store the collected toner 95 and surrounded by the cleaning casing 79*c*, the cleaning cover 79*d*, and the cleaning blade 72. Inside the storage chamber 71, a rib is provided that is a guide unit for guiding the movement of toner collected by the cleaning blade 72.

The cleaning casing 79*c* according to the present exemplary embodiment includes at a central portion in the lengthwise direction K a first protruded portion 79*c*1 protruding toward a downstream side from a surface 79*c*2 of a downstream portion in the conveying direction D (FIG. 1B) of the collected toner 95 (FIGS. 1A and 8A). Specifically, when the areas of cross sections orthogonal to the lengthwise direction K are compared, the cross sectional area of an inside of the storage chamber at a lengthwise center is larger than the cross sectional area of an inside of the storage chamber at a lengthwise end portion. This makes it possible to store more collected toner in a central portion including the lengthwise center. Further, the cleaning cover 79*d* includes a second protruded portion 79*d*1 provided in a position facing the first protruded portion 79*c*1 of the cleaning casing 79*c*. The second protruded portion 79*d*1 protrudes from a surface 79*d*2 toward the downstream side in the conveying direction D. Further, the cleaning cover 79*d* includes, at a central portion in the lengthwise direction K in an upward direction N (direction of an arrow N in FIG. 1B) vertical to the conveying direction D of the collected toner 95, a third protruded portion 79*d*3 protruding upward (a direction N) from a surface 79*d*4 (FIGS. 1B and 8B). As illustrated in FIG. 1B, the first protruded portion 79*c*1 and the second protruded portion 79*d*1 form a first space S (hatching area in FIG. 1B). Further, the third protruded portion 79*d*3 forms a second space U (hatching area in FIG. 1B). Accordingly, as illustrated in FIGS. 1B and 1C, in the conveying direction D, the collected toner storage capacity of the most-downstream part of the collected toner storage chamber 71 in the conveying direction D is larger at the lengthwise center by the first space S than at the respective lengthwise end portions. Specifically, when the cross sectional areas orthogonal to the lengthwise direction K are compared, the cross sectional area is larger at the lengthwise center by the space S than at the respective lengthwise end portions. Further, the collected toner storage capacity in the vertically upward direction N is larger by the second space U at the lengthwise center than at the respective lengthwise end portions. Accordingly, the collected toner storage capacity (or cross sectional area) of the collected toner storage chamber 71 is: at lengthwise center>at lengthwise end portions, indicating that the collected toner storage chamber 71 has different collected toner storage capacities in the lengthwise direction K.

Further, as illustrated in FIGS. 9A, 9B, and 9C, the cleaning casing 79*c* includes the rib 75, which is a guide unit for guiding the collected toner 95. The rib 75 includes ribs 75*a* to 75*e* in this order from the driving side. Further, the rib 75*a* will be used in the following description, because the ribs 75*a*, 75*b*, 75*d*, and 75*e* have the same structure.

The rib 75*a* includes an upstream guide unit 75*a*1 and a downstream guide unit 75*a*2. The upstream guide unit 75*a*1 is parallel to the conveying direction D, and the downstream guide unit 75*a*2 is provided in a downstream part in the conveying direction D of the collected toner 95. The downstream guide unit 75*a*2 is shaped toward the center of the collected toner storage chamber 71 relative to the conveying direction D. In this way, the conveying direction of the collected toner 95 in the downstream part in the conveying direction D is guided toward the downstream guide unit 75*a*2 (direction of an arrow E in FIG. 9A) by the downstream guide unit 75*a*2 to move to the center where the collected toner storage capacity is large. Details of the shape, angle, arrangement, etc. of the rib 75 will be described below.

Further, in the downstream part in the conveying direction D, end surfaces 75*a*3 and 75*e*3 of the downstream guide units 75*a*2 and 75*e*2 of the ribs 75*a* and 75*e* are not connected to the surface 79*c*2 of the conveyance downstream part. Further, downstream guide units 75*b*2 and 75*d*2 of the ribs 75*b* and 75*d* are connected to a surface 79*c*3 of the conveyance downstream part. The collected toner 95 in the respective end portions, where the collected toner storage capacity is small, in the lengthwise direction K are moved to the central portion, where the collected toner storage capacity is large, by the ribs 75*a* and 75*e* and does not stay at the surface 79*c*2 of the conveyance downstream part. Further, in a case where the user inclines the cartridge B while operating the cartridge B for jam recovery or the like, the unevenness of the collected toner 95 in the lengthwise direction K is reduced by the ribs 75*b* and 75*d*.

The following describes a process of storing the collected toner 95 with reference to FIGS. 9A, 9B, and 9C.

The residual collected toner 95 on the photosensitive drum 1 that has not been transferred is scraped by the cleaning blade 72 as the photosensitive drum 1 is rotated, and then the scraped toner is collected in the collected toner storage chamber 71. The cleaning blade 72 repeats the scraping so that the collected toner 95 is accumulated in the collected toner storage chamber 71 (FIG. 9A). The force that causes the collected toner 95 to move within the collected toner storage chamber 71 is a press by the newly-collected toner 95. The scraping is further repeated so that the new collected toner 95 pushes the already-collected toner 95 toward the downstream side of the collected toner storage chamber 71 in the conveying direction D to gradually store the collected toner 95 in the back portion of the collected toner storage chamber 71 (FIG. 9B). At this time, depending on the size of an image pattern or a sheet material P used by the user, the collected toner 95 may accumulate more in the both end portions of the collected toner storage chamber 71 in the lengthwise direction K. Even in this case, the collected toner 95 is guided to the center where the collected toner storage capacity is large so that the both end portions of the collected toner storage chamber 71 in the lengthwise direction K are prevented from being filled up, whereby the cleaning of the collected toner 95 on the photosensitive drum 1 can be continued. Then, at the end of the life of the cleaning apparatus 7, the collected toner 95 is stored in all the portions of the collected toner storage chamber 71 in the lengthwise direction K (FIG. 9C).

As the foregoing describes, the first protruded portion 79*c*1 is provided at the lengthwise center of the cleaning casing 79*c*, and the second protruded portion 79*d*1 and the third protruded portion 79*d*3 are provided at the lengthwise central portion of the cleaning cover 79*d*. This increases the collected toner storage capacity by the first space S formed by the first protruded portion 79*c*1 and the second protruded portion 79*d*1 and the second space U formed by the third protruded portion 79*d*3 when the cleaning casing 79*c* and the cleaning cover 79*d* are combined together. Further, the rib 75 is provided to the cleaning casing 79*c* to guide the collected toner 95 to the center where the collected toner storage capacity is large. Thus, even in the case where the collected toner 95 is accumulated more in the both end portions of the collected toner storage chamber 71 depending on the image pattern or the sheet material P used by the user, the cleaning blade 72 can stably collect the toner on the photosensitive drum 1. Accordingly, a cleaning apparatus can be provided that can stably store the collected toner 95 without increasing the collected toner storage chamber 71.

While in the present exemplary embodiment, the collected toner storage capacity of the lengthwise center of the collected toner storage chamber 71 is large, this is not a limiting example. For example, in a case of guiding the collected toner 95 to the both end portions of the collected toner storage chamber 71, first, second, and third protruded portions may be provided to the both end portions and the guide unit 75*e* of the rib 75 may be disposed to face the both end portions.

Further, while in the present exemplary embodiment, the first space S is formed by the first protruded portion 79*c*1 of the cleaning casing 79*c* and the second protruded portion 79*d*1 of the cleaning cover 79*d* and the second space U is formed by the third protruded portion 79*d*3, this is not a limiting example. The cleaning frame 79 may be formed by a single frame to form the first space S and the second space U.

Further, while in the present exemplary embodiment, the downstream guide units 75*b*2 and 75*d*2 of the ribs 75*b* and 75*d* are connected to the surface 79*c*3 of the conveyance downstream part, this is not a limiting example. In a case where the user does not need to operate the cartridge B at the time of jam recovery, the downstream guide units 75*b*2 and 75*d*2, like the ribs 75*a* and 75*e*, do not have to be connected to the surface 79*c*3 of the conveyance downstream part.

In the present exemplary embodiment, while the protruded portions appear to be protruded portions when visually observed from the outside, the portions are depressed portions when observed from the inside, and spaces in the depressed portions can further store the collected toner.

Figure 10A:
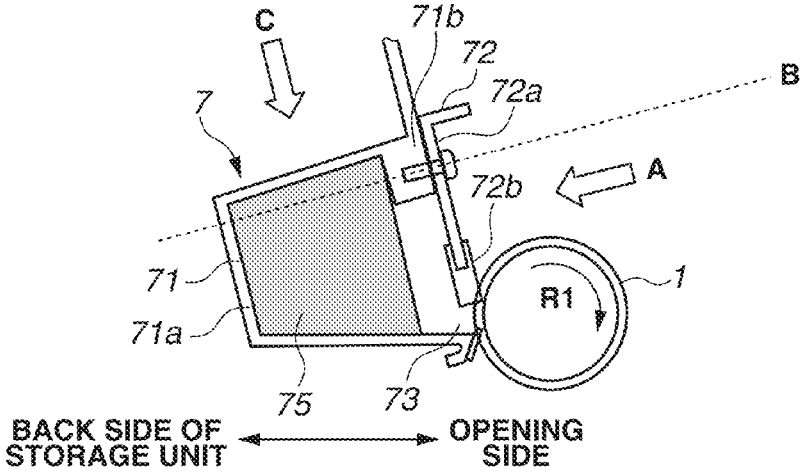
FIGS. 10A, 10B, and 10C are schematic views illustrating a cleaning apparatus according to a second exemplary embodiment of the present invention.
Figure 10B:
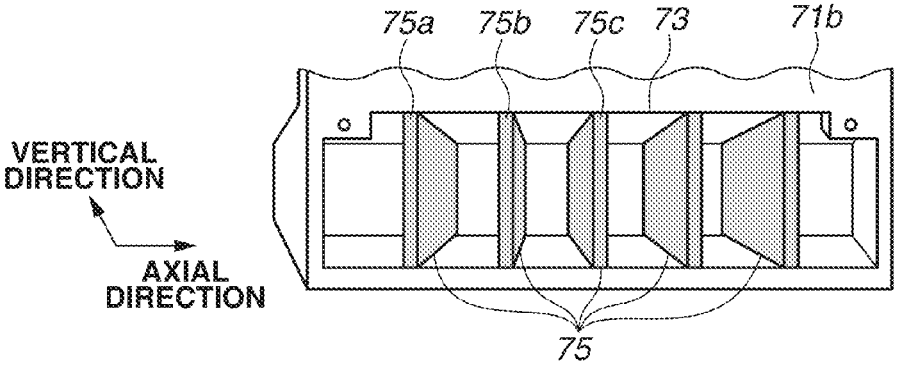
Figure 10C:
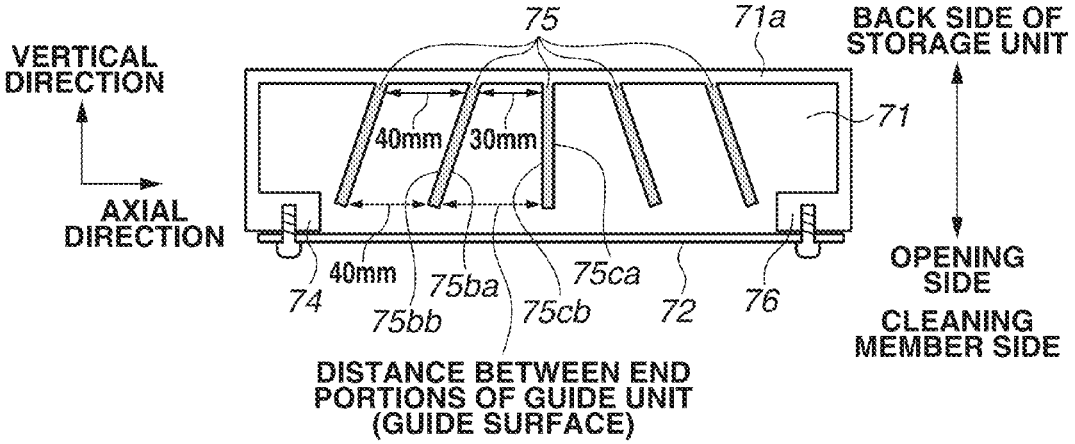

The following describes a second exemplary embodiment. A collected toner storage chamber 71 according to the present exemplary embodiment will be described in detail below with reference to FIGS. 10A, 10B, 10C, 11A, and 11B. FIG. 10A is a cross sectional view illustrating the cleaning apparatus 7. FIG. 10B is a perspective view illustrating the collected toner storage chamber 71 viewed from a direction A specified in FIG. 10A. FIG. 10C is a cross sectional view along a dotted line B specified in FIG. 10A that is viewed from a direction C.

The collected toner storage chamber 71 includes an opening 73 and bearing surfaces for fixing the cleaning blade 72. The opening 73 is a 240-mm opening extending lengthwise. The bearing surfaces are provided at respective ends of the opening 73 and have a width of 20 mm and a height of 10 mm. The depth of the storage chamber is 50 mm, and the height of a back portion 71*a* of the storage unit is 30 mm. Further, a plurality of guide units 75 serving as guide paths is provided to extend from a position at a distance of 5 mm from the opening 73 to a wall of the back portion 71*a* of the storage chamber. As to the positional relationship between end portions of the guide units near the opening 73, the end portion of each guide unit is provided with an interval of 40 mm from the end portion of the guide unit at the center of the opening 73. Further, two guide units are provided toward each end from the guide unit at the center. In FIGS. 10A-10C, the plurality of guide units 75 is provided, and each guide unit includes a surface (guide surface) for guiding the movement of the developer. In FIGS. 10A-10C, each guide unit includes a guide surface that guides the developer from the lengthwise end portion of the cleaning member to the lengthwise center in a direction away from the cleaning blade 72 (cleaning member). The interval between the guide surfaces is wide at the opening side and narrow at the side opposite to the opening side. In FIGS. 10A-10C, the second guide unit 75*b* from the lengthwise end portion includes two guide surfaces (first guide surface) 75*ba* and 75*bb* so that while the guide surface 75*ba* mainly guides the developer when the amount of collected toner is small, the guide surface 75*bb* also contributes to the guiding of the developer as the amount of collected toner increases. Further, positions of the guide units 75 near the opening 73 are also used as reinforcement plates (partition plates) to maintain the stiffness of the collected toner storage chamber 71. Thus, the guide units 75 need to be disposed as evenly as possible relative to the opening 73. Therefore, in the present exemplary embodiment, it is difficult to dispose the guide units 75 in the center. Further, at the back portion 71*a* of the collected toner storage chamber 71, the respective guide units are disposed with intervals of 30 mm and 40 mm, from the lengthwise center of the back portion. As to the guide unit at the lengthwise end portion of the cleaning member and the next (adjacent) guide unit, the distance between the end portions of the guide units on the opening (or cleaning member) side is the same as the distance between the end portions on the back portion side. In other words, the distances between the guide units are uniform. On the other hand, when the guide unit (including a second guide surface 75*ca*) at the center and the adjacent guide unit (including the first guide surface 75*ba*) are compared, the distance between the end portions of the guide units (guide surfaces) decreases toward the direction receding from the cleaning member. Specifically, at the cleaning member 71*b* side, the distance between the end portions of the guide units is 40 mm. On the other hand, at the back portion side of the storage chamber (side opposite to the cleaning member), the distance between the end portions of the guide units is 30 mm.

Further, the angle between the four guide units excluding the central guide unit 75*c* and the direction perpendicular to the axial direction of the photosensitive drum 1 is about 10°. Further, while five ribs are provided in the present exemplary embodiment to maintain the stiffness of the collected toner storage chamber 71, the number of ribs may be smaller than five if the stiffness of the collected toner storage chamber 71 can be maintained, or more than five ribs may be provided to secure the stiffness.

Figure 11A:
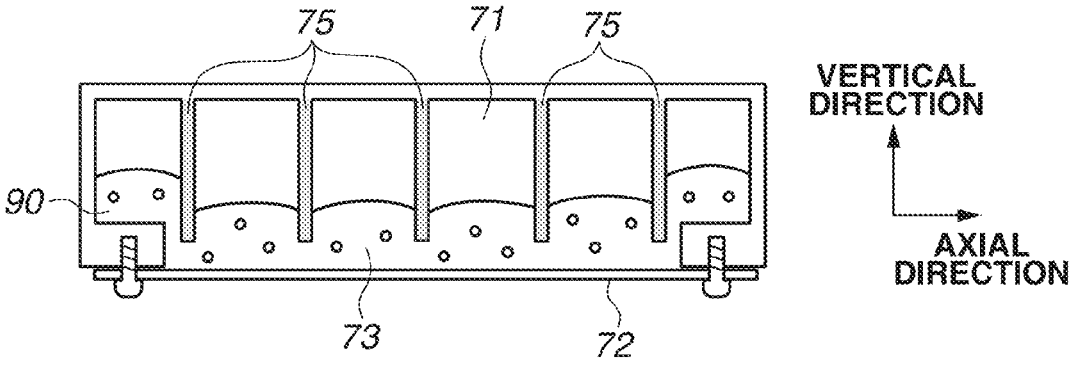
FIGS. 11A and 11B are schematic views illustrating a collected toner storage process according to a conventional structure.
Figure 11B:
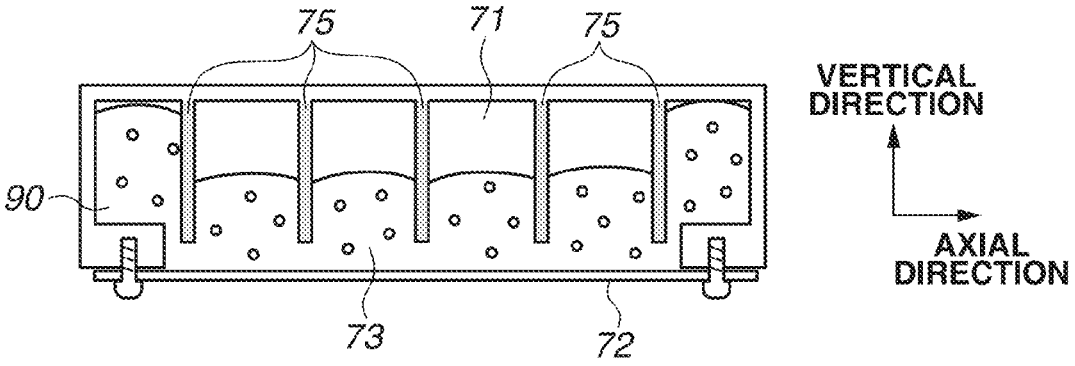

As illustrated in FIG. 11, a conventional rib shape is in a vertical direction relative to the axial direction of the photosensitive drum 1, and the collected toner is stored in a storage chamber corresponding to the collection position. Thus, toner collected at an end portion is stored in a storage chamber at the end portion, and if the amount of collected toner is large, the storage chamber at the end portion is filled up before a storage chamber at the center is filled up (FIG. 11B).

On the contrary, the rib-shaped guide units according to the present exemplary embodiment are disposed in a direction with an angle relative to the axial direction of the photosensitive drum 1 and the vertical direction. The direction is, for example, a direction that recedes from the cleaning member and is toward the lengthwise center of the cleaning member from the lengthwise end portion of the cleaning member. As described below, the guide units may be provided in a direction from the lengthwise center of the cleaning member toward the end portion. The guide units are provided in this way so that the collected toner that has been pushed in and traveled straight hits the guide surface 75*ba* of the guide unit 75, and the direction of movement (direction of travel) of the developer is changed to a direction parallel to the guide surface 75*ba*. Thus, a part of the toner collected at the end portion can be stored in the collected toner storage chamber 71 closer to the center. In this way, even when the amount of toner collected at the end portion is large, the developer can be stored in a uniform state so that the length of time during which the cleaning blade 72 can perform the cleaning can be increased.

Figure 12A:
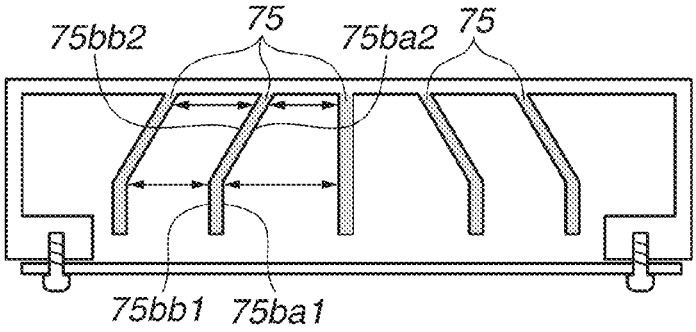
FIGS. 12A, 12B, 12C, and 12D are schematic views illustrating a cleaning apparatus according to the second exemplary embodiment of the present invention.
Figure 12B:
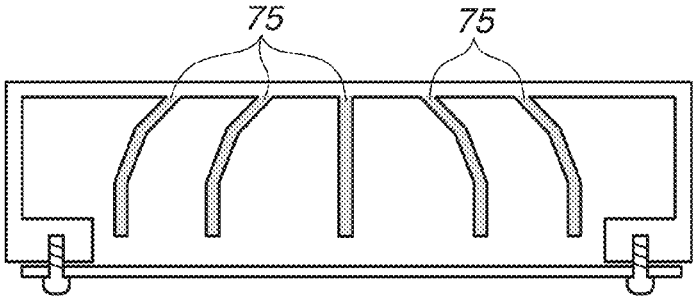
Figure 12C:
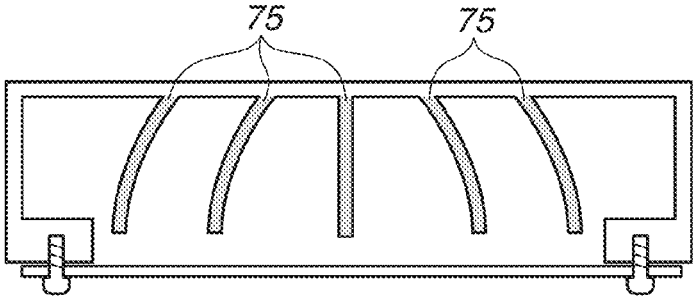

In the present exemplary embodiment, the angle between the guide unit and the direction perpendicular to the axial direction of the photosensitive drum 1 is 10°. The angle, however, is not limited to 10°. As illustrated in FIG. 12A, a portion near the opening may be in a direction perpendicular to the axial direction of the photosensitive drum 1 to enable smooth transmission of the toner push force to the back portion. Specifically, the guide unit includes a plurality of guide surfaces (two surfaces in FIG. 12A) 75*ba*1 and 75*ba*2, and one of the guide surfaces is the guide surface (third guide surface) 75*ba*1 perpendicular to the axial line. The other one of the guide surfaces, which is the guide surface (fourth guide surface) 75*ba*2, is a surface that guides the developer in a direction that recedes from the cleaning member and is toward the lengthwise center of the cleaning member from the lengthwise end portion of the cleaning member. In this case, the guiding angle of the developer is changed at least once at the guide surface. The angle of the guide surface is determined based on the properties of the toner, the force that pushes the toner to the storage chamber, the material and structure of the storage chamber, etc. and is preferably 45° or smaller. Thus, to significantly change the direction of storage of the developer, it is necessary to angle the guide surface in several parts (to include a plurality of guide surfaces) as illustrated in FIG. 12B. Similarly, as illustrated in FIG. 12C, the guide surface is in the form of a curved surface, i.e., at least a part of the guide unit is a curved surface, so that the toner in a further end portion can be stored in the center.

Figure 12D:
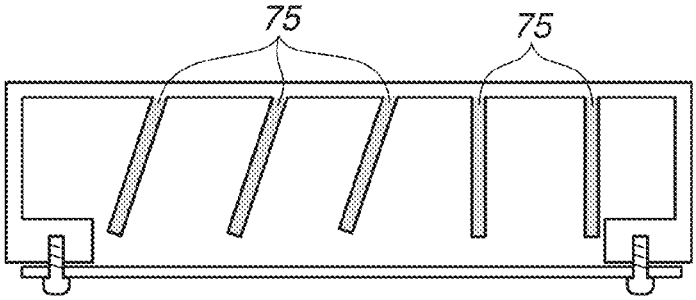

Further, while in the present exemplary embodiment, the case where a small recording material is aligned with the center of the photosensitive drum 1 has been described, there may be a case of aligning the small recording material with one side. In this case, as illustrated in FIG. 12D, the angles of the guide units are set to send the collected toner from left end portion, where a larger amount of toner is collected because the corresponding portion does not come into contact with the recording material, to the other (right) end portion. The angle at which the collected toner is to be sent is determined based on the amount of collected toner and is not limited by the central portion, the end portion, etc.

The following describes a third exemplary embodiment. FIGS. 13A, 13B and FIGS. 14A, 14B each illustrate a schematic view according to the present exemplary embodiment. The third exemplary embodiment is different from the second exemplary embodiment in that the amount of toner to be collected in the axial direction of the photosensitive drum 1 is uniform but the capacity of the collected toner storage chamber 71 is different. Since the basic apparatus structure is similar, the same reference numerals as those used in the second exemplary embodiment are given to avoid duplicate description, and only different points will be described.

The following describes the collected toner storage chamber 71, which is a feature of the present exemplary embodiment.

Figure 13A:
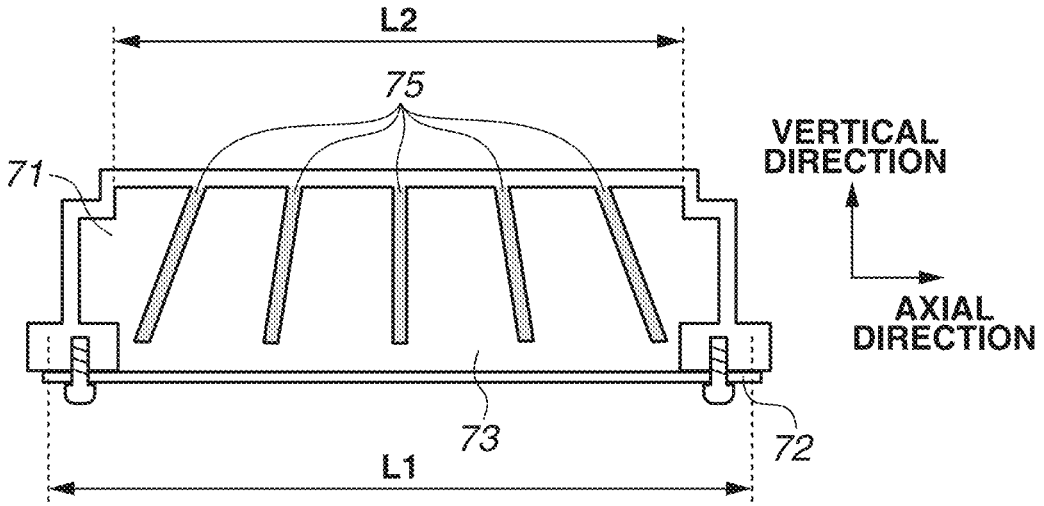
FIGS. 13A and 13B are schematic views illustrating a cleaning apparatus according to a third exemplary embodiment of the present invention.
Figure 13B:
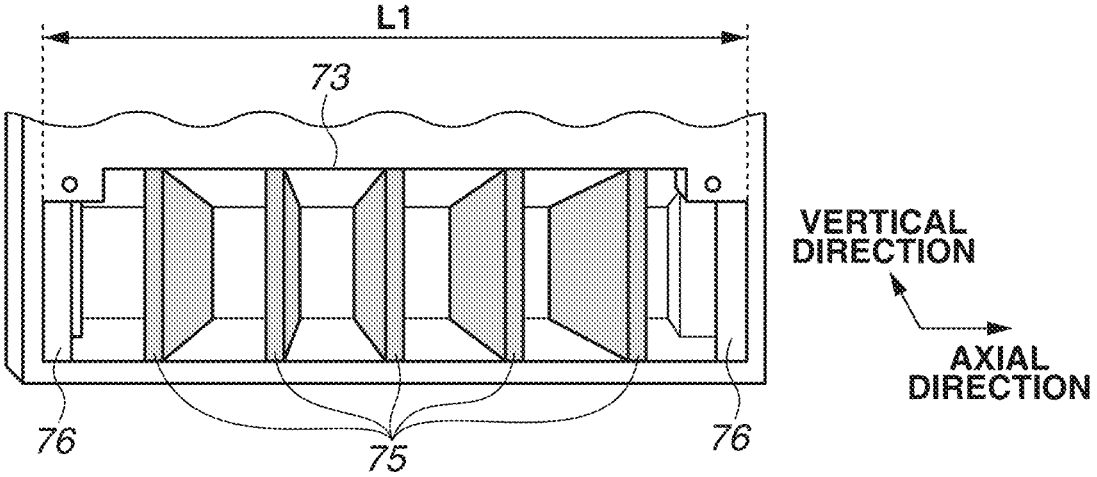
Figure 14A:
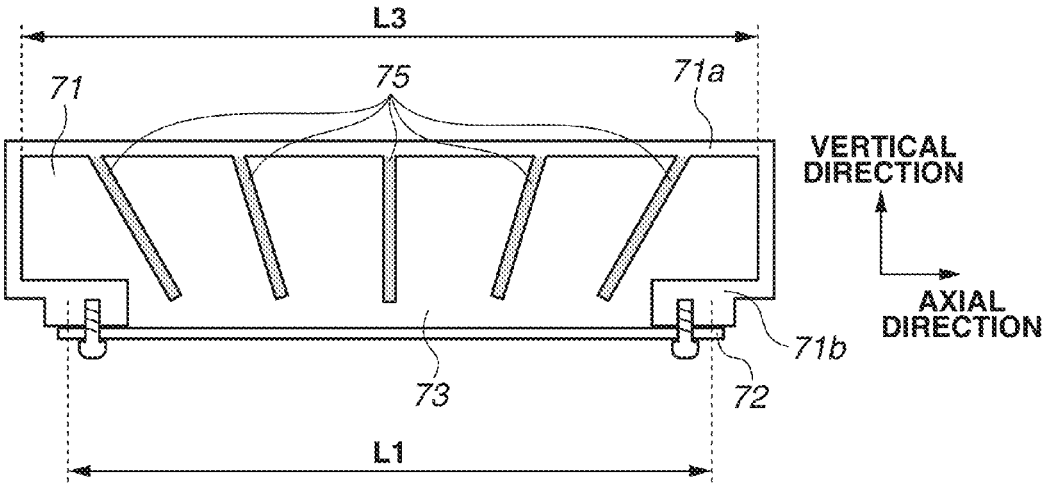
FIGS. 14A and 14B are schematic views illustrating a cleaning apparatus according to the third exemplary embodiment of the present invention.
Figure 14B:
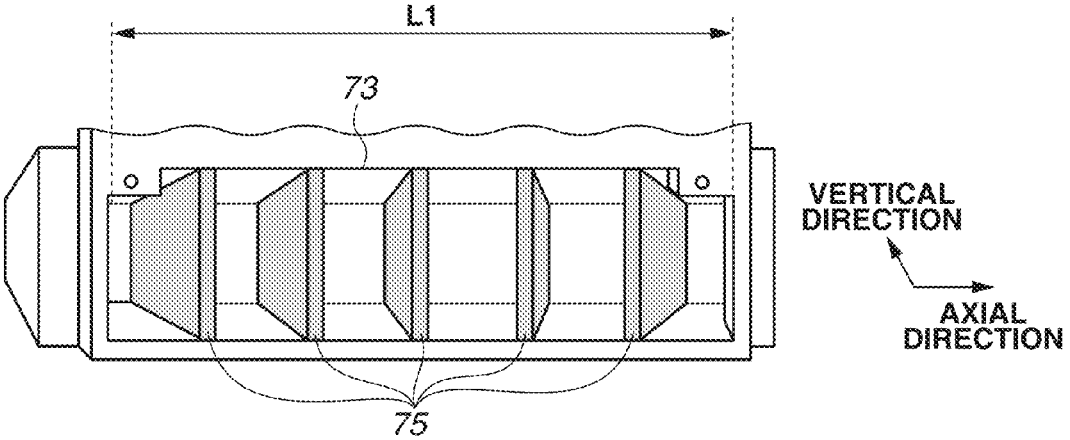

To improve usability at the time of insertion of the cleaning apparatus 7 into the image forming apparatus, a width (L2) of the back portion 71*a* is smaller than a width (L1) of the opening 73 in the collected toner storage chamber 71 illustrated in FIGS. 13A, and 13B. Further, to seal a gap between the cleaning blade 72 and the storage chamber with a simple seal, a bearing surface of the seal needs to be disposed inside the cleaning blade 72. Due to the foregoing functions, the width of the collected toner storage chamber 71 is narrower than the width (L1) of the opening. In such a case, with the conventional rib shape, even if the amount of collected toner is uniform, the collected toner cannot be stored uniformly because the capacity of the storage chamber of the end portion is small. Specifically, only the storage chamber at the end portion is filled up so that the collection of toner by the cleaning blade 72 cannot be continued. In the present exemplary embodiment, the width (L2) of the back portion of the storage chamber is 220 mm, and the width of the bearing surface of the seal that fills in the gap between the end portion of the cleaning blade and the casing is 5 mm. The guide units 75 as guide paths are provided, one at the center and two toward one end and another two toward the other end. The end portions of the guide units 75 close to the opening 73 (guide unit end portions on the opening side) are disposed with an interval of 40 mm. The end portions of the guide units 75 at the back portion of the storage chamber are disposed with an interval of 30 mm. The guide unit 75 (guide surface) at the center is provided in a vertical direction (vertical surface) relative to the axial direction of the photosensitive drum 1. The angle of each guide unit adjacent to the guide unit at the center is 10°, and the angle of an adjacent guide unit at each end is 20°. In this way, the collected toner storage chamber 71 has about the same capacities relative to the opening width. Thus, the collected toner can be stored in a uniform state in the collected toner storage chamber 71 so that the collection of the toner on the photosensitive drum 1 by the cleaning blade 72 can be continued.

Further, in a case where a large-capacity cartridge is used or the cleaning apparatus 7 is repeatedly used with replenishment of the developer, a large amount of toner needs to be collected and stored. In such a case, as illustrated in FIGS. 14 A and 14B, a width (L3) of the collected toner storage chamber 71 may be larger than the width (L1) of the opening 73. With the conventional rib shape, only a small amount of collected toner is stored in the end portions of the storage chamber outside the opening width portion. Thus, even when the capacity of the collected toner storage chamber 71 is increased, the amount of stored collected toner remains virtually the same. In the present exemplary embodiment, the width (L3) of the back portion 71*a* of the storage chamber is 270 mm. The guide units 75 serving as guide paths are provided, one at the center and two toward one end and another two toward the other end. The end portions of the guide units 75 that are close to the opening are disposed at the center and at intervals of 40 mm from the center. The end portions of the guide units 75 in the back portion of the storage chamber are provided at the center and at intervals of 50 mm from the center. The angle of each guide unit close to the center is 10°, and the angle of the guide unit at each end is 20°.

Specifically, each guide unit includes a guide surface configured to guide the developer in a direction that recedes from the cleaning member and is toward the lengthwise end portion of the cleaning member from the lengthwise center of the cleaning member. In this way, as in the exemplary embodiments described above, the collected toner can be stored in a uniform state in the collected toner storage chamber 71 so that the collection of toner on the photosensitive drum 1 by the cleaning blade 72 can be continued.

Figure 15:
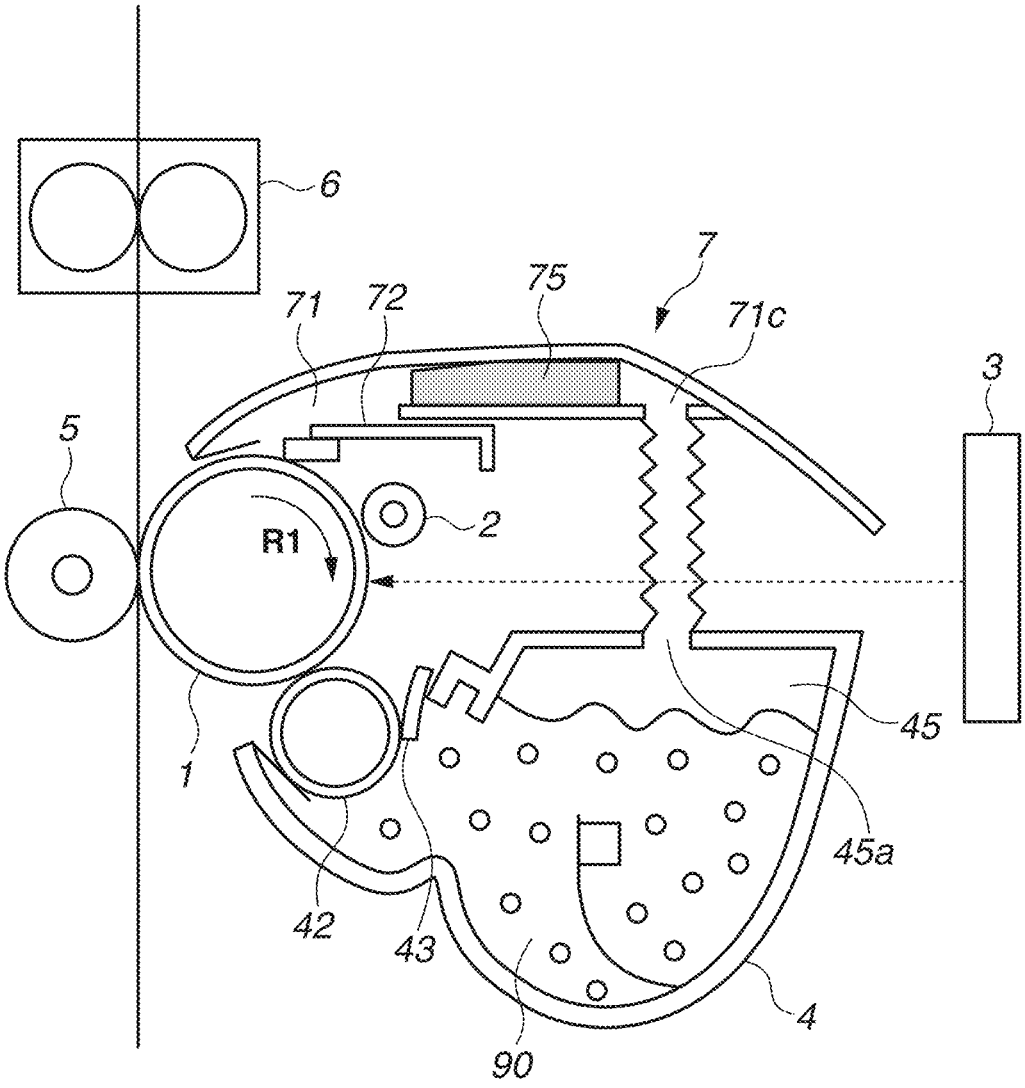
FIG. 15 is a schematic view illustrating an image forming apparatus according to a fourth exemplary embodiment of the present invention.

The following describes a fourth exemplary embodiment. FIG. 15 illustrates a schematic view according to the present exemplary embodiment. The fourth exemplary embodiment is different from the second exemplary embodiment in that a toner storage chamber and a collected toner storage chamber 71 are included. Since the basic apparatus structure is similar, the same reference numerals as those used in the second exemplary embodiment are given to avoid duplicate description, and only different points will be described.

The following describes the toner storage chamber 45 and the collected toner storage chamber 71, which are features of the present exemplary embodiment.

As illustrated in FIG. 15, the toner storage chamber 45 is connected to the development device 4. The toner storage chamber 45, however, is not limited to the foregoing toner storage chamber and may be a storage chamber included in the body of the image forming apparatus and stores collected toner. The toner storage chamber 45 may be any storage chamber for storing toner and is not limited to a specific toner storage chamber.

Figure 16A:
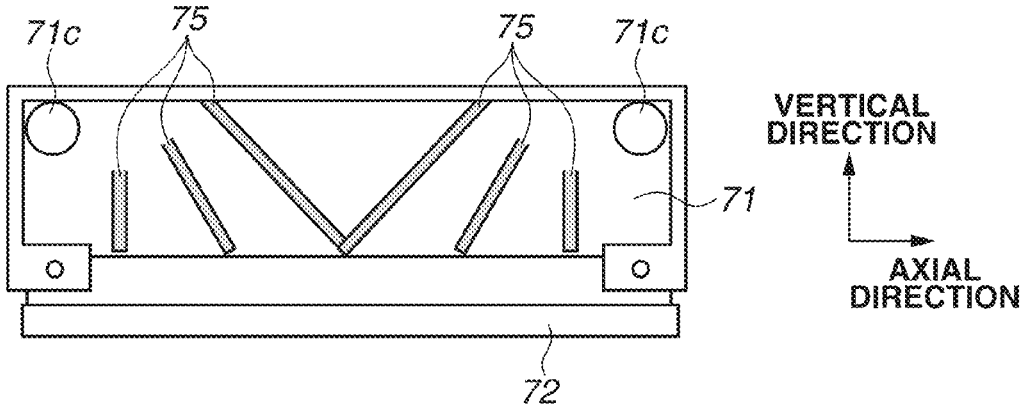
FIGS. 16A and 16B are schematic views illustrating a cleaning apparatus according to the fourth exemplary embodiment of the present invention.

As illustrated in FIG. 16A, in the present exemplary embodiment, the collected toner storage chamber 71 includes an outlet with a diameter of 15 mm in each end of the back portion and is connected to the toner storage chamber 45 by an extensible tube made of polyethylene terephthalate (PET). Toner discharged from the outlet is introduced through an inlet 45*a* of the toner storage chamber. The guide units 75 serving as guide paths are disposed such that the collected toner is conveyed to the outlets 71*c*. In the present exemplary embodiment, six guide units 75 are provided in total and are disposed symmetrically. The respective angles between the respective guide units and the direction perpendicular to the axial direction of the photosensitive drum 1 are 0°, 10°, and 20°, from the end portion. In this way, the direction of movement of the toner collected by the cleaning blade 72 can be changed to the outlets 71*c* so that the collection of toner on the photosensitive drum 1 by the cleaning blade 72 can be continued.

Figure 16B:
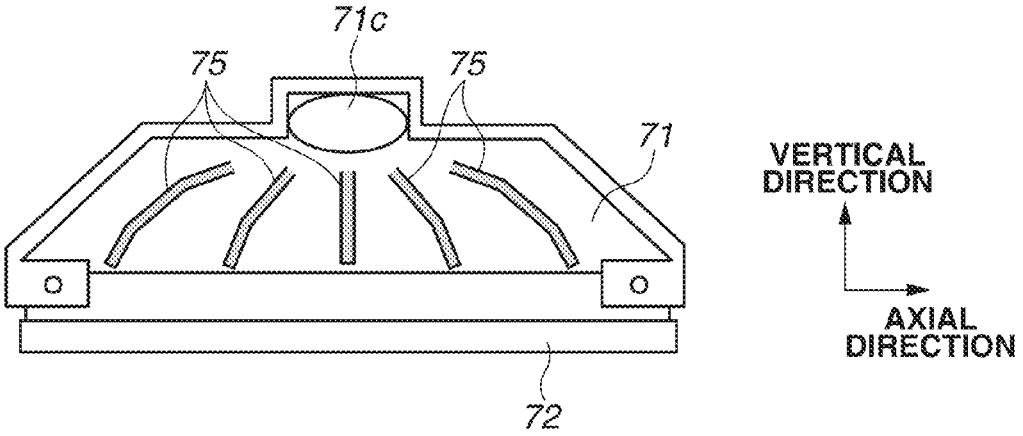

Further, while in the present exemplary embodiment, the outlets 71*c* are formed in the respective end portions, one outlet 71*c* may be formed at a center, as illustrated in FIG. 16B. The shape and number of outlets are not particularly limited.

While the cleaning apparatus and the storage chamber in FIG. 15 have a one-to-one relationship, a full-color copying machine or the like may have a structure in which a plurality of cleaning apparatuses is connected to a single storage chamber and toner collected from the plurality of cleaning apparatuses is accumulated in the storage chamber. In this case, the storage chamber is generally included in a body of the image forming apparatus, but a process cartridge or a development device may include the storage chamber.

(Other Structure)

While the foregoing describes the structures in which the guide units are provided in the storage chamber of the cleaning apparatus, a casing that includes a guide unit capable of guiding developer is also applicable to other apparatuses.

In the present exemplary embodiment, the guide units may also be provided to the storage chamber of the development device. In this case, for the development device configured to perform development, the guide units for guiding a developing agent are provided in a direction that is toward developer bearing member and toward a lengthwise center of the developer bearing member from a lengthwise end portion of the developer bearing member.

Further, depending on the apparatus structure, the guide units for guiding developer may be provided in a direction that is toward a developer bearing member and toward a lengthwise end portion of the developer bearing member from a lengthwise center of the developer bearing member. Especially in the structure in which a developer casing is a separate casing and is attached to a development device to supply developer, the developer supplied from the developer casing does not stay in one place and can be supplied uniformly to the developer bearing member.

According to an exemplary embodiment of the present invention, collected developer can be stably stored.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application 2014-192223, filed Sep. 22, 2014, and No. 2015-006005, filed Jan. 15, 2015, which are hereby incorporated by reference herein in their entirety.

What is claimed is:

1. A cleaning apparatus comprising:

a cleaning frame provided with a storage chamber, the storage chamber is configured to store the developer;

a cleaning member configured to collect developer on an image bearing member located in the cleaning frame; and a guide rib provided on an inner surface of the storage chamber and configured to guide movement of the developer collected by the cleaning member, wherein the guide rib includes a guide surface configured to guide the developer in a direction that recedes from the cleaning member, and wherein the guide surface inclines toward the lengthwise center portion of the cleaning member from the lengthwise end portion of the cleaning member.

2. The cleaning apparatus according to claim 1, wherein in a case where the guide surface is a first guide surface and a guide surface perpendicular to an axial line of the image bearing member is a second guide surface, the cleaning apparatus includes the first guide surface and the second guide surface.

3. The cleaning apparatus according to claim 2, wherein a distance between an end portion of the first guide surface and an end portion of the second guide surface on a side close to the cleaning member is longer than a distance between an end portion of the first guide surface and the end portion of the second guide surface on a side opposite to the cleaning member.

4. The cleaning apparatus according to claim 1, wherein the cleaning apparatus includes a plurality of the guide ribs, and wherein a distance between the guide ribs decreases in a direction receding from the cleaning member.

5. The cleaning apparatus according to claim 1, wherein the cleaning apparatus includes a plurality of the guide ribs, and wherein the plurality of the guide ribs include a guide rib connected to the cleaning frame in a downstream part in the direction receding from the cleaning member, and a guide rib not connected to the cleaning frame in the downstream part in the direction receding from the cleaning member.

6. A cleaning apparatus comprising:

a cleaning frame provided with a storage chamber, the storage chamber is configured to store the developer;

a cleaning member configured to collect developer on an image bearing member located in the cleaning frame; and a guide rib provided on an inner surface of the storage chamber and configured to guide movement of the developer collected by the cleaning member, wherein the guide rib includes a guide surface configured to guide the developer in a direction that recedes from the cleaning member, and wherein the guide surface inclines toward the lengthwise end portion of the cleaning member from the lengthwise center portion of the cleaning member.

7. A cleaning apparatus comprising:

a cleaning frame provided with a storage chamber, the storage chamber is configured to store the developer;

a cleaning member configured to collect developer on an image bearing member, located in the cleaning frame; and a guide rib provided on a inner surface of the storage chamber and configured to guide movement of the developer collected by the cleaning member, wherein the cross-sectional areas of the storage chamber are different in a lengthwise direction of the storage chamber, the cross-sections being orthogonal to the lengthwise direction, and wherein the guide rib includes a guide surface which inclines in a direction from the small cross-sectional area toward the large cross-sectional area, in the lengthwise direction.

8. The cleaning apparatus according to claim 7, wherein in a case where the guide surface is a first guide surface and a guide surface perpendicular to an axial line of the image bearing member is a second guide surface, the cleaning apparatus includes the first guide surface and the second guide surface.

9. The cleaning apparatus according to claim 8, wherein a distance between an end portion of the first guide surface and an end portion of the second guide surface on a side close to the cleaning member is longer than a distance between an end portion of the first guide surface and the end portion of the second guide surface on a side opposite to the cleaning member.

10. The cleaning apparatus according to claim 7, wherein the cleaning apparatus includes a plurality of the guide ribs, and wherein a distance between the guide ribs decreases in a direction receding from the cleaning member.

11. The cleaning apparatus according to claim 7, wherein the cleaning apparatus includes a plurality of the guide ribs, and wherein a distance between the guide ribs is uniform.

12. The cleaning apparatus according to claim 7, wherein a direction and an angle at which the guide rib guides movement of the developer is changed at least once.

13. The cleaning apparatus according to claim 7, wherein at least a part of the guide rib is a curved surface allowing guiding in the direction of the curved surface.

14. The cleaning apparatus according to claim 7, wherein the storage chamber includes an opening, and wherein in a lengthwise direction of the cleaning member, a length of the opening is longer than a length of a back portion of the storage chamber on a side opposite to the opening.

15. The cleaning apparatus according to claim 7, wherein the storage chamber includes an opening, and wherein in a lengthwise direction of the cleaning member, a length of the opening is shorter than a length of a back portion of the storage chamber on a side opposite to the opening.

16. The cleaning apparatus according to claim 7, further comprising the image bearing member.

17. A process cartridge comprising:

an image bearing member; and the cleaning apparatus according to claim 7.

18. An image forming apparatus comprising the cleaning apparatus according to claim 7, wherein the image forming apparatus forms an image on a recording material with the developer.

19. The image forming apparatus according to claim 18, wherein in a case where the storage chamber is a first storage chamber including an outlet through which developer is to be discharged, the image forming apparatus further includes a second storage chamber including an inlet through which the developer discharged from the outlet is to be introduced, and configured to store the developer.

20. The image forming apparatus according to claim 19, further comprising a development device configured to develop an electrostatic image on the image bearing member, wherein the development device includes the second storage chamber.

21. The image forming apparatus according to claim 19, wherein the second storage chamber is connected to the cleaning apparatus.

22. The cleaning apparatus according to claim 7, wherein in the lengthwise direction, the cross-sectional area at a lengthwise center portion is larger than the cross-sectional area at a lengthwise end portion, and wherein the guide surface inclines in a direction toward the lengthwise center portion from the lengthwise end portion.

23. The cleaning apparatus according to claim 22, wherein at the lengthwise center portion, the storage chamber includes a protruded portion so that the cross-sectional area of the lengthwise center of the storage chamber is larger than the cross-sectional area of the end portion.

24. The cleaning apparatus according to claim 23, wherein the cleaning frame includes a first frame and a second frame, and the protruded portion is formed by the first frame and the second frame.

25. The cleaning apparatus according to claim 7, wherein the cleaning apparatus includes a plurality of the guide ribs, and wherein the plurality of the guide ribs include a guide rib connected to the cleaning frame in a downstream part in the direction receding from the cleaning member, and a guide rib not connected to the cleaning frame in the downstream part in the direction receding from the cleaning member.

* * * * *